US005303764A

United States Patent [19]

Sasaki et al.

[11] Patent Number: 5,303,764

[45] Date of Patent: Apr. 19, 1994

[54] DIE FOR FORMING ALUMINUM SILICON ALLOY

[75] Inventors: Masato Sasaki; Yoshihiro Yamada, both of Kanagawa, Japan

[73] Assignee: Atsugi Unisia Corporation, Kanagawa, Japan

[21] Appl. No.: 993,629

[22] Filed: Dec. 21, 1992

Related U.S. Application Data

[62] Division of Ser. No. 675,330, Mar. 26, 1991, Pat. No. 5,211,778.

[30] Foreign Application Priority Data

Mar. 27, 1990 [JP] Japan ..... 2-75577
Nov. 20, 1990 [JP] Japan ..... 2-312851

[51] Int. Cl.[5] ..... B22D 17/04

[52] U.S. Cl. ..... 164/312; 148/552; 148/432; 164/306; 164/348; 249/135

[58] Field of Search ..... 249/135; 164/306, 312, 164/348; 148/432, 552; 420/495

[56] References Cited

U.S. PATENT DOCUMENTS 4,637,451 1/1987 Perrella et al. ..... 249/135

*Primary Examiner*—R. Dean
*Assistant Examiner*—Robert R. Koehler
*Attorney, Agent, or Firm*—Bachman & LaPointe

[57] ABSTRACT

An aluminum-silicon alloy having excellent mechanical characteristics is formed by pressure casting of a molten material concurrently with modifying thereof by a flux which includes at least one element selected from the group of Na, Sb, Sr, and/or Ca, allowing a substantially fine grain of silicon to be dispersed in the alloy. Alternatively, the step of the pressure casting is replacable by substantial uniform cooling of the molten material regardless of a thickness thereof by cooling a die having a mold formed of a Cu-W type material, which mold corresponds to a substantially thick portion of the alloy.

2 Claims, 5 Drawing Sheets

DIE FOR FORMING ALUMINUM SILICON ALLOY

This is a division of application Ser. No. 675,330 filed Mar. 26, 1991, now U.S. Pat. No. 5,211,778.

BACKGROUND OF THE INVENTION

1. Field of the Invention

The present invention relates generally to a method of making an aluminum-silicon alloy. Specifically, the present invention relates to a method of making an aluminum-silicon alloy in which a fine grain of silicon is formed.

2. Description of The Background Art

Generally, manufacturing of aluminum alloys for automotive members, such as piston for combustion or manifold for inlet and outlet, have been accomplished by die casting as die casting is convenient for mass production and space omission when manufacturing.

Conventionally, such aluminum alloys have been accomplished by casting Al-8Si alloy under conditions of high pressure to solidify the alloy, as is well known in the art. In this method, thermal conductivity between a die and the molten alloy are raised, that is, time for cooling the alloy is shorter, then grain size of silicon included in the alloy can be 20 to 30% finer compared with that formed by conventional gravity casting.

On the other hand, modification treatments of molten alloy by addition of a flux including Na, Sr, Sb, and/or Ca are also well known in the art in order to reduce the grain size of silicon.

Generally, the fineness of grain in silicon greatly influences fatigue resistance of the alloy. For example, the tensile strength of aluminum-silicon alloy becomes larger as the eutectic silicon diameter therein becomes smaller.

However, both of the above-mentioned methods have limitations. When solidifying, a cooling time for a pressure cast alloy at wall thickness portions of an article formed of the alloy cannot be reduced easily compared to those at relatively thinner portions. On the other hand, using modification treatment, grain size of the eutectic silicon diameter cannot be controlled until the cooling speed of the alloy becomes relatively fast. Therefore, modification treatment is not sufficient for thicker portions of an article formed of the alloy. An alloy article formed by die casting may have a quite complicated shape, therefore, it is difficult to establish sufficiently fine silicon particles throughout the whole of the alloy article.

Thus, the grain size of silicon crystals becomes coarse and size and distribution of the silicon crystals varies depending on alloy thickness. That is, the alloy elements cannot be distributed homogeneously through the whole alloy. Therefore, when the alloy structure is stabilized by the well known solution heat treatment, mechanical characteristics of the alloy cannot be raised unless time for the solution heat treatment is prolonged.

Additionally, when an alumite coating is made on the desired portion of the alloy surface, thickness of the alumite coating cannot be made constant because various sizes of silicon crystals are distributed in the alloy. Further, the surface of the alumite coating becomes rough because the alloy surface becomes porous, thus mechanical strength of the alloy cannot be raised.

SUMMARY OF THE INVENTION

It is therefore a principal object of the present invention to provide a method for forming an aluminum-silicon alloy having fine silicon crystals evenly distributed therein throughout the whole thickness of the alloy.

It is another object of the present invention to provide a method for forming an aluminum-silicon alloy having excellent mechanical characteristics.

It is a further object of the present invention to provide a method for forming an aluminum-silicon alloy with significantly reduced surface porosity.

It is an additional object of the present invention to provide a method for forming an aluminum-silicon alloy which will allow application of a smooth alumite coating.

In order to accomplish the aforementioned and other objects, a method for forming an aluminum-silicon alloy article comprises the steps of —:—: adding a flux to a molten alloy material for modification of the material—and—; casting the molten material under pressure to accelerate a cooling speed of the material—wherein—: the step of modification cooperates with the step of casting for allowing a substantially fine grain size of silicon to be included in the material.

The flux includes at least one element selected from the group consisting of Na, Sr, Sb, and Ca.

The pressure may be determined at, at least, 200 $kg/cm^2$.

Alternatively, a method for forming an aluminum-silicon alloy article comprises the steps of—:—; adding a flux to a molten alloy material for modification of the material; pouring the material into a pre-cooled die; and cooling, substantially uniformly, the material in the die to form the aluminum-silicon alloy, and wherein the step of modification of the molten material cooperates with the step of cooling the material for allowing a substantially fine grain of silicon to be included in the material.

The die may comprise a mold formed of a Cu-W type of alloy material substantially removable of heat from the material, the mold corresponding to a substantially thick portion of the article.

The alloy can be stabilized by solution heat treatment. Alternatively, it can be coated after heating and working of the alloy. Coating can be accomplished by an anodic coating technique, and the coating may be of alumite.

A die for forming an aluminum-silicon alloy article comprises a mold formed of Cu-W type of alloy material substantially removable of heat from a molten alloy poured thereinto, and cooling means for cooling the die and the molten alloy, the mold corresponds to a substantially thick portion of an aluminum-silicon alloy article, and the cooling means substantially uniformly cools the molten alloy.

The cooling means can be formed as a water conduit suppliable to the mold for uniform cooling of the mold and the molten alloy.

BRIEF DESCRIPTION OF THE DRAWINGS

The present invention will be understood more fully from the detailed description given hereinbelow and from the accompanying drawings of the preferred embodiments of the invention. However, the drawings are not intended to imply limitation of the invention to a specific embodiment, but are for explanation and understanding only.

In the drawings:

FIG. 3(*b*) is a graph showing a relationship between pressure and DAS when casting under pressure with modification;

FIG. 4(*b*) is a graph showing a relationship between casting pressure and silicon grain size with modification;

DESCRIPTION OF THE PREFERRED EMBODIMENT

Figure 1:
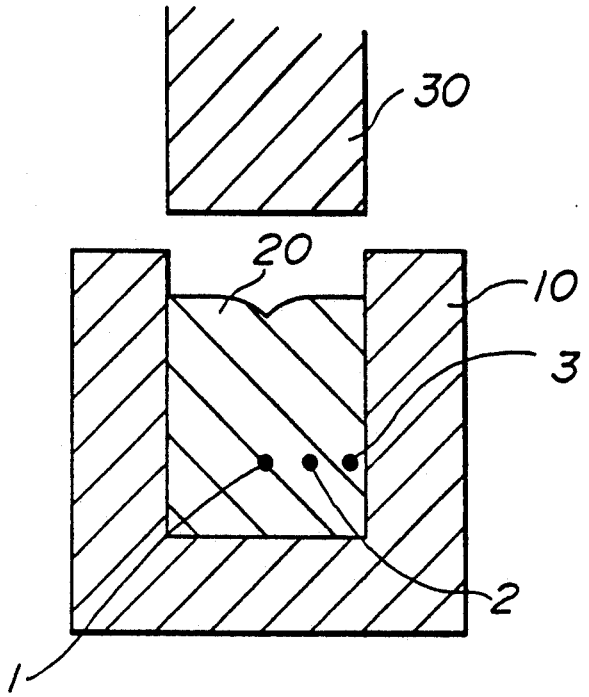
FIG. 1 is a sectional view of a die for forming aluminum alloy articles for characteristic tests between alloys according to the present invention and alloys formed by conventional method.

Referring now to the drawings, particularly to FIG. 1, which shows a die for forming an aluminum-silicon alloy article, supplied for characteristic tests between the alloys of the present invention and those of the conventional art, a molten alloy 20 for forging is poured into a mold 10, then pressed by a press punch 30 in order to solidify the alloy. Temperature of solidification is measured adjacent the center portion of the mold 10 (1), adjacent the side wall of the mold 10 (3), and at a point therebetween (2), each point being positioned 35 mm from the bottom of the mold 10. The molten alloy 20 is AC8A having a composition as indicated in the following Table 1.

TABLE 1

| Chemical Composition of the Molten Alloy (AC8A) | | | | | | | |
|---|---|---|---|---|---|---|---|
| Si | Cu | Mg | Mn | Ni | Fe | Ti | Al |
| 11.5 | 1.05 | 1.14 | 0.08 | 1.22 | 0.50 | 0.20 | balance |

EXAMPLE 1

Material of the molten alloy, having a chemical composition as mentioned above, was melted in a graphite crucible. Then the molten alloy was allowed to stand for a predetermined time. A flux of Na type (50 ppm of Na) was added to the molten alloy immediately after standing, and the mixture was left for 30 min. Thus, modification treatment of the alloy was made. The modified mixture was poured into a die at a temperature of 720°±15° C. Temperature of the die was 150°±5° C. The alloy was cast under pressure under the conditions indicated in the following Table 2.

TABLE 2

| Sample No. | Forging Conditions Pressure kg/cm$^2$ | Na Treatment |
|---|---|---|
| 1 | 0 | No |

TABLE 2-continued

| Sample No. | Forging Conditions Pressure kg/cm$^2$ | Na Treatment |
|---|---|---|
| 2 | 200 | No |
| 3 | 500 | No |
| 4 | 2000 | No |
| 5 | 0 | Yes |
| 6 | 200 | Yes |
| 7 | 500 | Yes |
| 8 | 2000 | Yes |

Figure 2:
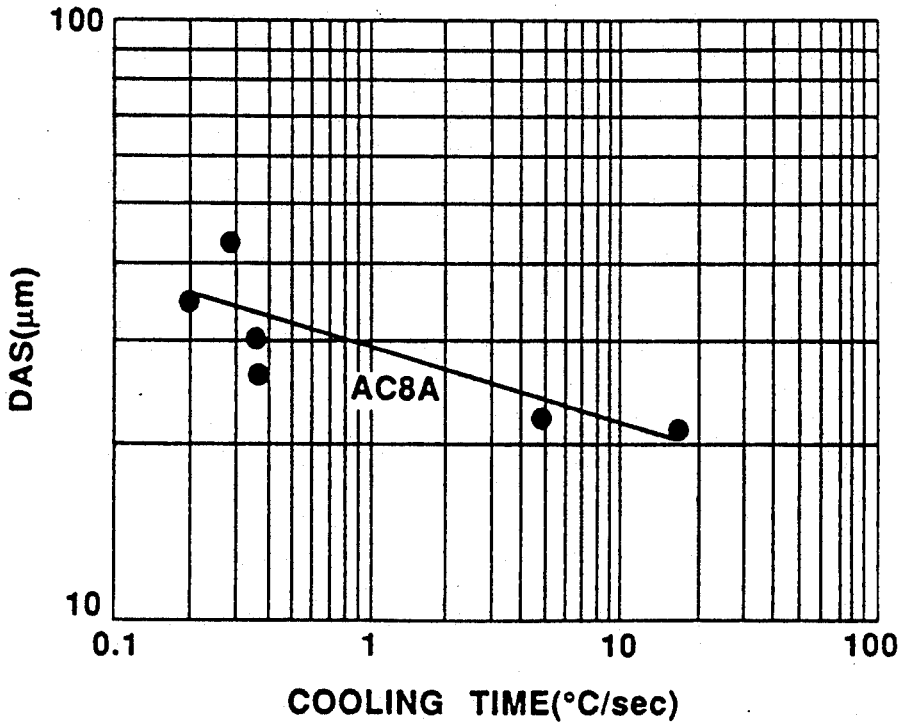
FIG. 2 is a graph showing a relationship between cooling time and dendrite arm spacing (DAS), which shows the degree of fineness of a structure made of ACA8 alloy.

Degree of fineness of crystals in the forged alloy was measured by image analysis of Dendrite Arm Spacing (DAS) at the previously mentioned three points in the alloy. DAS has well known characteristics which correlate with the cooling time of the alloy. FIG. 2 shows a relationship between DAS and cooling time for AC8A.

Figure 3:
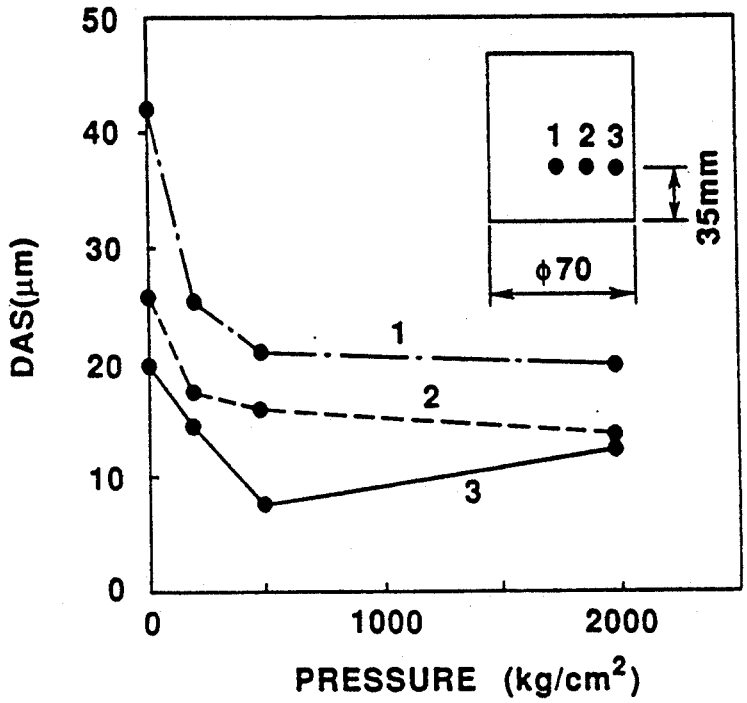
FIG. 3(*a*) is a graph showing a relationship between pressure and DAS when casting under pressure without modification.
Figure 3:
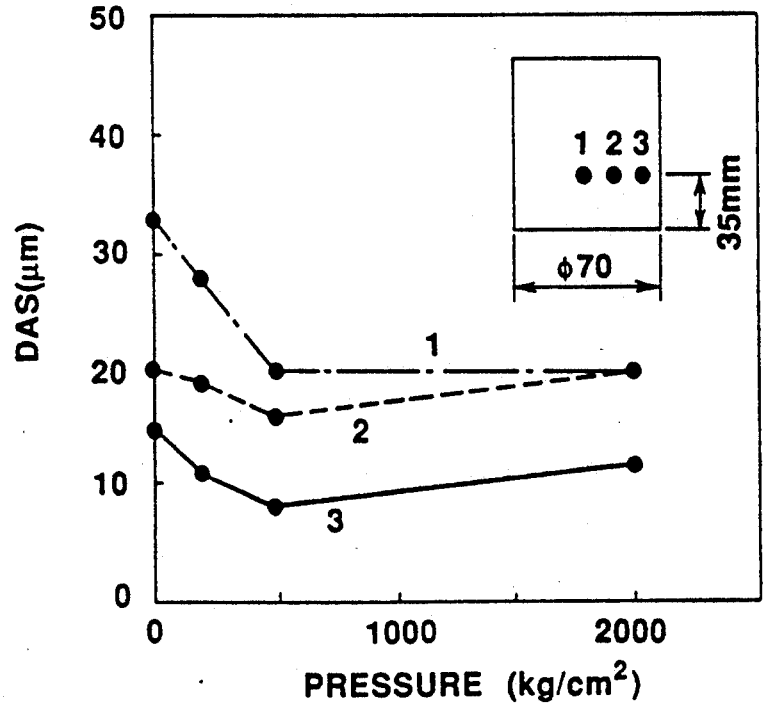

FIGS. 3(*a*) and 3(*b*) indicate relationships between DAS and casting pressure, 3(*a*) shows the results when Na treatment was not made (Samples No. 1 to 4) and 3(*b*) shows results for samples to vhich Na treatment was made (Samples No. 5 to 8). Referring now to these FIGURES, DAS becomes constant (10 to 22 μm) at a pressure of 500 kg/cm$^2$ regardless of whether or not Na treatment is performed. Additionally, a difference between a DAS value measured at points 1 and 3 becomes smaller corresponding to higher pressure. That is, the results indicate that a time difference for cooling the alloy depending the measuring position can be eliminated. Therefore, the structure of an alloy article can be homogenized by high pressure.

Table 3 shows a cooling time calculated from the obtained DAS by gravity forging and the casting under pressure method of the present invention.

TABLE 3

| Pressure (kg/cm$^2$) | Alloy Cooling Time Na Treatment | Cooling Time (°C./sec) 1 | 2 | 3 |
|---|---|---|---|---|
| 0 | No | 0.24 | 0.37 | 5.00 |
| | Yes | 0.56 | 0.93 | 5.33 |
| 200 ~ 2000 | No | | 18.0 ~ 20.0 | |
| | Yes | | 18.0 ~ 20.0 | |

It is clear from the aforementioned Table 3 that time for cooling or cooling rate, for the alloy according to casting under pressure is about 50 times that of the alloy according to the gravity casting, at a center adjacent portion of the alloy, and is also about 3 to 4 times even adjacent the circumference of the alloy. The cooling time was not influenced specifically by Na treatment.

Figure 4A:
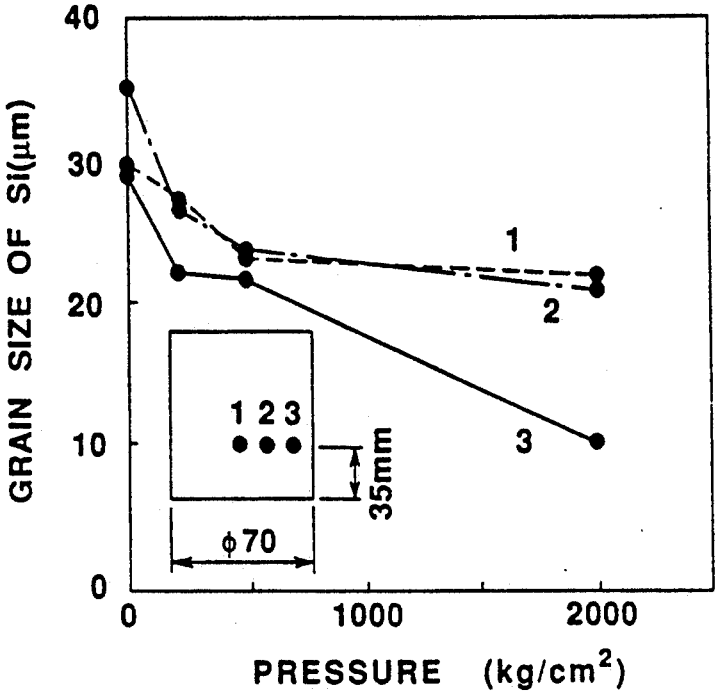
FIG. 4(*a*) is a graph showing a relationship between casting pressure and silicon grain size without modification.
Figure 4B:
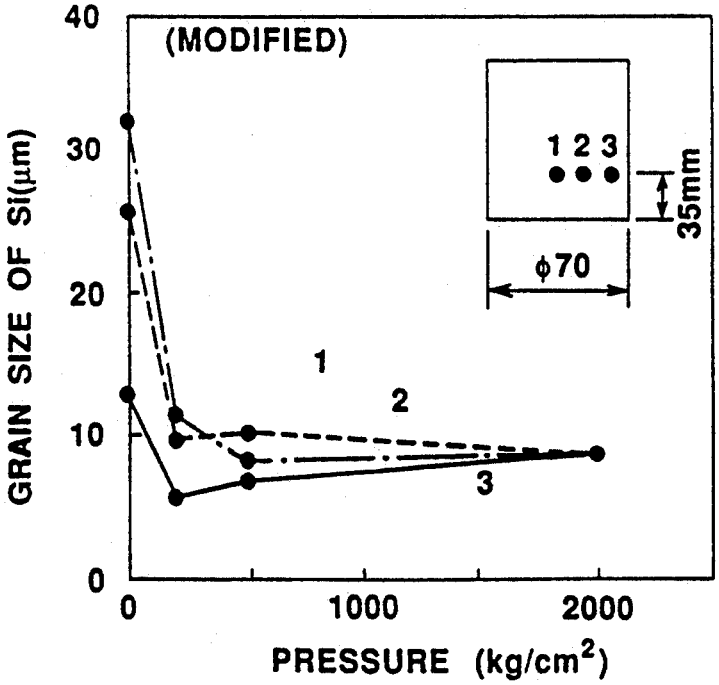

FIGS. 4(*a*) and 4(*b*) show a relationship between the casting pressure and a grain size of Si, FIG. 4(*a*) shows results when Na treatment was not performed (Samples No. 1 to 4) and FIG. 4(*b*) shows results when Na treatment was performed (Samples No. 5 to 6). When modification treatment with Na was made, the grain size of Si becomes smaller by about 10 μm corresponding to higher pressure. However, when modification treatment with Na was not performed, the grain size of Si is relatively large (about 20 μm) at center adjacent portions of the alloy when the pressure becomes substantially high (e.g. 2000 kg/cm$^2$), although the grain size tends to become finer according to the pressure rising. That is, the modification treatment of the alloy using Na flux is a substantially effective treatment for obtaining fine grained Si in alloy at relatively low pressure (i.e., relatively slow cooling)compared to the untreated forging. Additionally, when Na treatment only was performed (i.e., pressure is 0), fineness of grain is only obtained at positions where cooling is accomplished speedily (i.e., at measuring point 3). Thus, modification treatment with Na together with casting under pressure is very effective for obtaining fineness of Si grain regardless of its position in the alloy.

Figure 5:
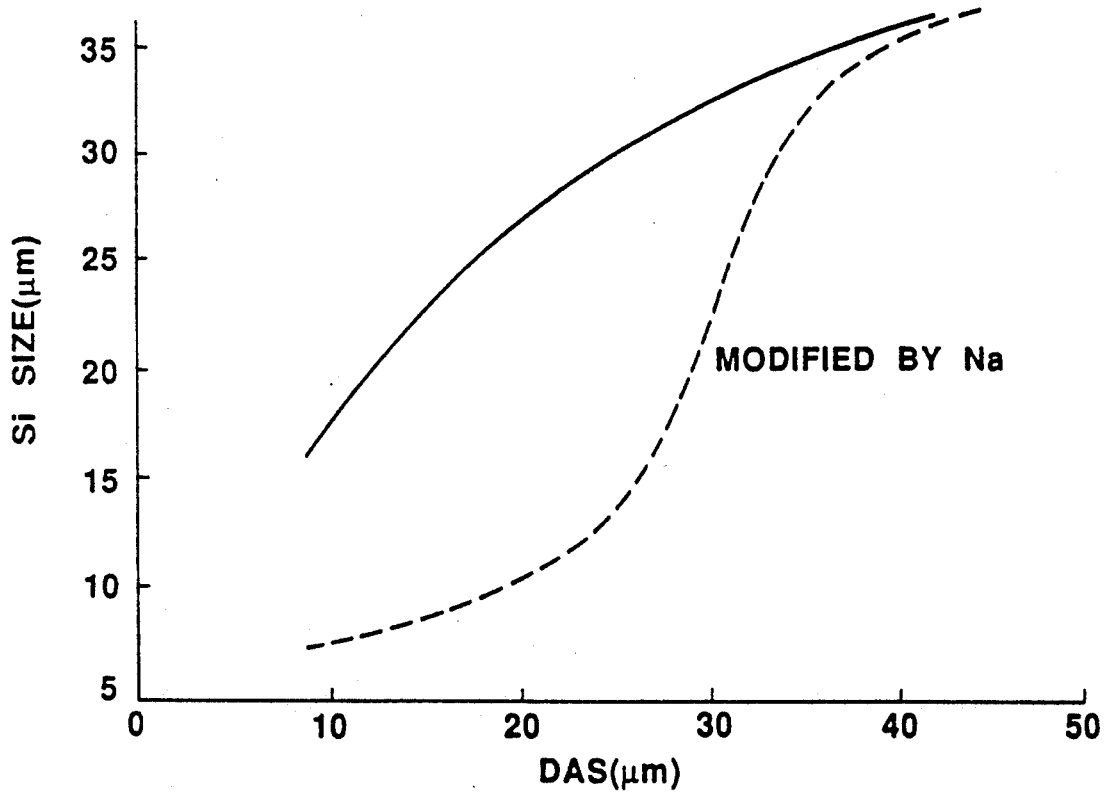
FIG. 5 is a graph showing a relationship between DAS and silicon grain size.

Referring now to FIG. 5 showing a relationship between DAS and the grain size of Si, Na treatment is most effective when DAS is less than 25 μm. However, the difference in the fineness effect between treated and untreated cases becomes small when DAS is more than 25 μm and less than 10 μm. This range of DAS can be accomplished by casting under pressure. Therefore, applying high pressure with casting concurrently with modification treatment using Na flux is most effective for fineness of Si, compared with conventional methods, for example, gravity casting with no modification, gravity casting with modification, or pressure forging with no modification.

As previously mentioned, it is well known in the art that fineness of Si significantly influences a degree of fatigue resistance in the alloy. Therefore, fatigue testing of the alloy having the aforementioned composition, cast under pressure by the method of the present invention and by conventional method was made. In the test, solution heat treatment of the alloy was made at 510° C. for 1.5 hours then the alloy was allowed to stand at 200° C. for 6 hours. Sampling for the test was made at the point 1, adjacent the center portion of the alloy article. The results are shown in the following Table 4.

TABLE 4

| Sample Strength against Fatigue | | | |
|---|---|---|---|
| Na treatment | Pressure ($kg/cm^3$) | Grain size of Si (μm) | Tensile Strength ($kg/mm^3$) |
| Yes | 200 | 12 | 5.0 |
| Yes | 0 | 32 | 3.8 |
| No | 200 | 28 | 4.0 |
| No | 0 | 35 | 3.9 |

It is clear from the above results that tensile strength of an alloy article can be highly raised by pressure casting with Na modification according to the present invention.

While the aforementioned example shows several comparisons between the present invention and conventional casting, the method of the invention is not limited to using Na as a flux, but other elements for modification such as Sr, Sb, or Ca may be used.

Figure 6:
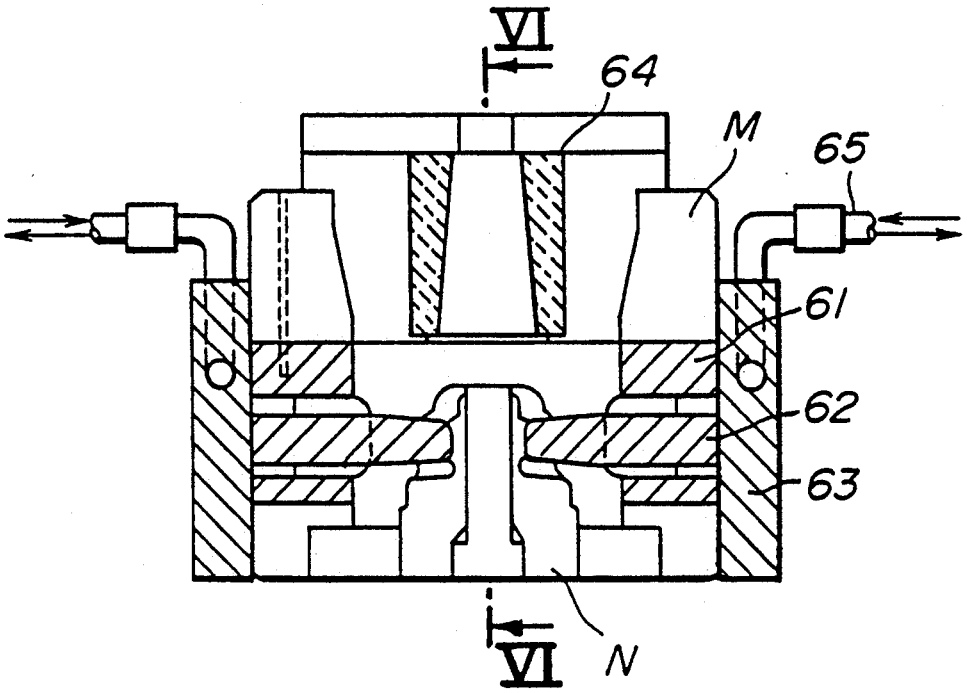
FIG. 6 is a sectional view of a die for a second embodiment of the present invention.

Referring now to FIG. 6 showing a die 60 for a second embodiment of the present invention, a first chilling block 61 positioned at a land portion of the die corresponding to a substantially thick portion of the alloy article and a second chilling block 62 positioned at a pin hole portion of the die are formed of alloy materials of a Cu-W type having good thermal conductivity. A back plate 63 of a mold M is formed of Cu. An insert die 64 is formed of ceramics having high insulation properties, and other members are formed of Fe type alloy materials. The surface of the mold M where it contacts molten aluminum alloy is covered by a mold covering material which is hard to wet and is thermally conductive, such as a $W_2C$ type material, in order to protect the surface of the mold. A core N is disposed in the mold M.

A coolant conduit 65 for feeding a predetermined amount of cooling water is communicated with the back plate 63. Feeding is started before the molten alloy is poured into the mold, and is finished before the die is opened. Because the land portion and the pin hole portion (substantially thick portion) of the alloy article have enhanced thermal exchange efficiency due to the chilling blocks 61 and 62 formed of Cu-W type material, these portions and a skirt portion of the alloy article (thin portion) formed of Fe type material may be cooled uniformly. A portion of the molten alloy at the feeding point is solidified slower than the land portion because the insertion mold 64, formed of a ceramic such as aluminum titanate, is arranged in the mold M at the a portion corresponding to the feeding portion.

Figure 7:
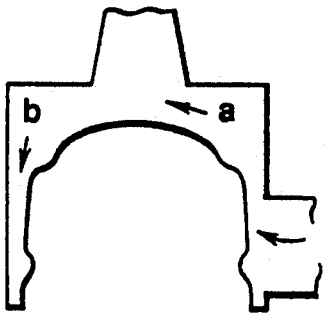
FIG. 7 is a sectional view taken along line VI—VI of FIG. 6.

When molten aluminum-silicon alloy (AC8A) modified by a flux including Na, Sb, Ca, or Sr is poured into the die, the molten alloy is circulated in the mold M in the direction of the lines a and b shown in FIG. 7 which schematically indicates a sectional view of FIG. 6 along the line VI—VI. Thus, directional solidification of the molten alloy can be accomplished while obtaining maximum cooling effect (i.e., about 15° C./sec). Therefore, the grain size of the silicon can be uniformly fine over the whole of the alloy article by synergetic effect of the cooling for homogenizing the die temperature and by modification due to the flux. Aluminum alloy articles formed as described above were removed from the die and supplied the following examples.

EXAMPLE 2

An aluminum alloy article removed from the above-mentioned die was put into a furnace for solution heat treatment in an atmosphere of 500° C. After leaving for a predetermined duration, the solid solution of the alloy was put into a water bath then tempered at 200° for 8 hours. Mechanical characteristics of obtained samples according to the present invention and the conventional art were compared while the time of solution heat treatment was varied. The results are indicated in the following Table 5.

TABLE 5

| Mechanical Characteristics and Time for Solution heat treatment | | | | | |
|---|---|---|---|---|---|
| Sample | Time for Treatment (min.) | Tensile Strength ($kg/mm^2$) | 0.2% Yield Point ($kg/mm^2$) | Elongation (%) | Impact Value |
| No Treatment | 0 | 31.2 | 34.6 | ≦0.2 | 0.07 |
| | 10 | 35.4 | 35.1 | ≦0.2 | 0.08 |
| | 15 | 36.7 | 35.4 | ≦0.2 | 0.08 |
| | 120 | 36.8 | 35.1 | 0.3 | 0.08 |
| Cooling + Flux | 0 | 39.4 | 35.6 | 1.5 | 0.20 |
| | 10 | 42.2 | 36.4 | 1.8 | 0.23 |
| | 15 | 43.1 | 37.4 | 2.0 | 0.24 |
| | 120 | 43.0 | 37.1 | 2.1 | 0.25 |

From the aforementioned Table 5, uniform cooling and modification treatment can maintain mechanical characteristics of the alloy even when the time for solution heat treatment is shortened to just 10 to 15 minutes.

Fatigue testing of alloy articles, using AC8A material, made by both methods was performed. The material was formed into a piston and maximum stress was measured at a stroke count of $10^7$. The results are shown in the following Table 6.

TABLE 6

Fatigue Resistance of AC8A Article (N = 10)

| Sample No. | Die Cooling | Flux | Time for Treatment (hr.) | Time for Tempering (hr.) | Rigidity |
|---|---|---|---|---|---|
| 1 | No | No | 1.5 | 8 | 9.9 |
| 2 | No | No | 0.5 | 8 | 8.2 |
| 3 | Yes | No | 1.5 | 8 | 14.1 |
| 4 | Yes | Yes | 1.5 | 8 | 15.8 |
| 5 | Yes | Yes | 0.5 | 8 | 15.5 |

Note:

Nos. 1 and 2: use S45C for the mold, diatomaceous earth for the coating

Nos. 3 to 5: using same die as previously shown in FIG. 6

Rigidity in samples No. 1 and 2 is reduced as the time of solution heat treatment is shortened. However, rigidity in samples No. 3 to 5 are maintained constant. Therefore, mechanical strength of the alloy article can be substantially maintained regardless of the time of solution heat treatment by uniform cooling. Additionally, rigidity in a sample cooled uniformly can be raised 40% higher than that of a conventionally cooled sample. Further, when the flux is added such as in sample No. 5, mechanical strength of the alloy article can be maintained at a high level. Therefore, uniform cooling and modification treatment of the molten alloy can derive synergetic effect of strengthening of the alloy article.

EXAMPLE 3

Surface treatment of the previously obtained aluminum-silicon alloy article was performed. The surface of the alloy article was coated with alumite by anodic coating as follows. An aluminum-silicon alloy piston form was dipped into 28±2% of a $H_2SO_4$ solution. Temperature of the solution was determined at 4±1° C., and electrolysis was applied for 25 min. under 1.6 $A/dm_2$ of current density.

Roughness of the alumite coating on the surface of the article was measured at several points. The obtained results are shown in the following Table 7.

TABLE 7

Distribution of Roughness of the Coating

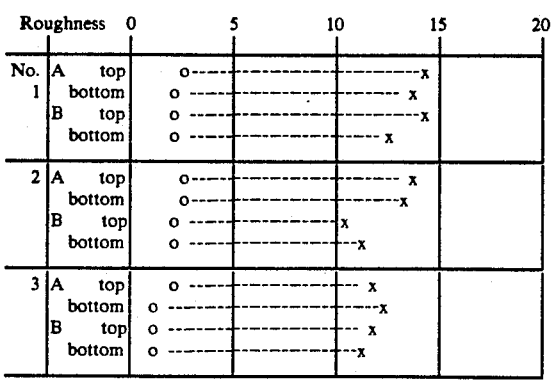

TABLE 7-continued

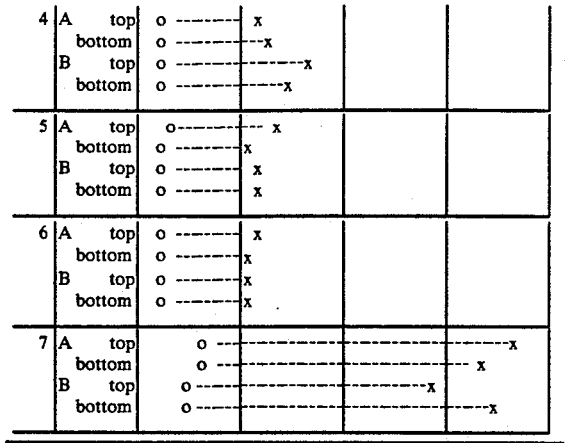

Note
A and B: measuring points
Nos. 1 to 3: uniform cooling
Nos. 4 to 6: uniform cooling with modification
No. 7: no treatment
(o: average, x: maximum value)

From the results, roughness of the alumite coating of Nos. 4 to 6 is about ⅓ less than that of the other samples.

According to the present invention, fineness of silicon grain size over the whole of an aluminum-silicon alloy article of various thicknesses requiring various times for cooling can be accomplished by pressure forging with flux modification. Therefore, mechanical strength against fatigue of the article can be uniformly raised throughout the article. Further, porosity of the article can be reduced by forging with pressure, therefore, the mechanical characteristics of the article can be raised still higher.

Alternatively, fineness of grain size of silicon can also be accomplished by homogenizing the difference of time consumed for cooling. Because the molten alloy is poured into a die which is cooled uniformly beforehand, the molten alloy is cooled speedily, and the modification effect of added flux is coupled with this cooling. Therefore, the molten alloy can be cooled uniformly throughout the article, and the grain size of the silicon can be homogeneously fine. Therefore, mechanical characteristics are significantly enhanced, and time for solution heat treatment of the article can be greatly shortened. Accordingly, manufacturing steps of the solution heat treatment can be shortened, and furnace costs for the treatment can be reduced. Furthermore, because of the fine grain size of the silicon in the article, the article can be coated by a coating material, such as alumite, with substantially less coating roughness than possible with prior methods. Therefore, manufacturing steps for coating treatment can be simplified, so time for alumite treatment can be shortened and manufacturing costs can be further reduced.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modification to the shown embodiments which can be embodied without departing from the principle of the inventions as set forth in the appended claims.

What is claimed is:

1. A die for forming an aluminum-silicon alloy article comprising:
   - a mold formed of Cu-W of alloy material substantially removable of heat from a molten alloy poured thereinto;
   - cooling means for cooling said die and said molten alloy;
   - said mold corresponding to a substantially thick portion of an aluminum-silicon alloy article; and
   - said cooling means substantially uniformly cools said molten alloy.

2. A die as set forth in claim 1, wherein said cooling means is a conduit of water suppliable to said mold for uniform cooling of said mold and said molten alloy.

* * * * *